US005839504A

United States Patent [19]

Matsuda

[11] Patent Number: 5,839,504

[45] Date of Patent: Nov. 24, 1998

[54] PRECISION CASTING TITANIUM ALUMINIDE

[75] Inventor: Kenji Matsuda, Matsudo, Japan

[73] Assignee: Ishikawajima-Harima Heavy Industries Co., Ltd., Tokyo, Japan

[21] Appl. No.: 158,658

[22] Filed: Nov. 29, 1993

Related U.S. Application Data

[62] Division of Ser. No. 17,563, Feb. 16, 1993, abandoned.

[30] Foreign Application Priority Data

Feb. 19, 1992 [JP] Japan ..... 4-69832

[51] Int. Cl.[6] ..... B22D 21/00; B22D 27/04

[52] U.S. Cl. ..... 164/516; 164/47; 164/122.1

[58] Field of Search ..... 164/516, 122.1, 164/47, DIG. 15

[56] References Cited

U.S. PATENT DOCUMENTS 4,849,168 7/1989 Nishiyama et al. ..... 420/418

FOREIGN PATENT DOCUMENTS 0469525 2/1992 European Pat. Off. .
3-193837 8/1991 Japan .
3-257130 11/1991 Japan .

*Primary Examiner*—J. Reed Batten, Jr.
*Attorney, Agent, or Firm*—Thomas K. Ziegler

[57] ABSTRACT

A titanium aluminide is composed of 31.5 to 33.5 weight % of Al, 1.5 to 2.3 weight % of Fe, 1.5 to 2.1 and 3.7 to 4.8 weight % of Nb, 0.07 to 0.12 weight % of B with remainder being Ti and inevitable impurities. The 1.5–2.0 weight % of Nb may be replaced with 0.5 to 2.0 weight % of V if severe oxidation resistance is not necessary. The titanium aluminide is melted and poured into a mold, and the melt is cooled in the mold naturally.

16 Claims, 5 Drawing Sheets

MECHANICAL PROPERTIES OF Ti−(31∼34)Al−1.5Nb 1.8Fe−0.1B (WEIGHT %) (AS CAST)

HARDNESS OF Ti−32Al−(1.5~5.0)Nb(1.8,2.3)Fe−0.1B (×200)

(X400)

(X400)

PRECISION CASTING TITANIUM ALUMINIDE

This is a divisional of application Ser. No. 08/017,563 filed on Feb. 16, 1993 and now abandoned.

BACKGROUND OF THE INVENTION

1. Technical Field

The present invention relates to titanium aluminide which is used as a material for precision casting, and particularly to titanium aluminide used for turbine parts, automobile parts and the like.

2. Background Art

Titanium aluminide (an intermetallic compound known by the chemical formula of TiAl (this substance will be referred to as "TiAl" hereinafter)) is drawing attention as an advanced light weight and heat resisting material. This is because the high specific strength of TiAl at elevated temperature is better than those of the nickel-base heat-resisting alloys, and the heat resistance, oxidation resistance and hydrogen embrittlement resistance of TiAl are better than those of the titanium alloys. Since TiAl possesses these and other admirable properties, there are demands to make aircraft jet engine parts such as blades and vanes out of this material.

On the other hand, however, TiAl has low ductility at ambient temperature and a strong dependency on the strain rate even at high temperatures (even at 700° C. or more) where sufficient toughness develops. This makes the machining or processing difficult. Therefore, TiAl cannot be used as a practical material up to now. Solving these difficulties contributes a lot to next generation aircraft Jet engines and the like and therefore research is being conducted from crystal structural and physical metallurgical viewpoints. As a result of such research, methods of improving the low ductility by strengthening the grain boundaries and causing the plastic deformation by deformation twinning have been proposed in, for example, Japanese Patent Application Nos. 61-41740, 1-255632, 1-287243 and 1-298127.

In spite of these efforts, however, misrun and cracks occur during the casting operation when TiAl is used to produce thin and complicated castings such as shrouded turbine blades.

Regarding the above, the assignee of the present invention proposed a new TiAl, which is superior in castability, in Japanese Patent Application No. 4-88140, published Mar. 23, 1992 (or U.S. Pat. No. 5,296,055 or European Patent Application EP-A-0 469 525) and FIG. 8 of the accompanying drawings shows this. This TiAl does not have coarse lamellar structure (FIG. 10), but microstructure (FIG. 8), i.e., dispersed whisker-like (actually, flake-type) Ti-B compounds (TiB, $Ti_3B_4$, $TiB_2$).

Since the coarse lamellar grains cause crackings but TiAl of FIG. 8 does not have such coarse lamellar grains, TiAl of FIG. 8 has an excellent castability.

However, further research has revealed that the TiAl of FIG. 8 has too much dispersoids of Ti-B compounds, and the Ti-B compounds will become starting points of fatigue failure thereby reducing the fatigue properties.

TiAl is expected as a new light-weight heat-resisting, material, but conventional TiAl is difficult to process and the yield of the casting made from conventional TiAl is low.

SUMMARY OF THE INVENTION

An object of the present invention is to provide TiAl that has an improved castability and oxidation resistance but does not have the dispersed Ti-B compounds which reduce the fatigue properties.

According to one aspect of the present invention, there is provided TiAl which comprises Al 31.5–33.5% by weight, Fe 1.5–2.3% by weight, Nb 1.5–2.1 and 3.7–4.8% by weight and B 0.07–0.12% by weight, with remainder being Ti and inevitable impurities. V 1.5–2.0% may be used instead of Nb if a strong oxidation resistance is not necessary for a product.

According to another aspect of the present invention, there is provided a method of producing a casting using the above TiAl, which comprises the steps of melting the TiAl, pouring the molten TiAl into a mold and cooling it naturally.

The weight percents of the respective elements of the TiAl are determined due to following reasons:

If Al is less than 31.5%, particularly if an Al/Ti ratio is smaller than 0.49, the cold (or ambient temperature) ductility drops considerably, and if Al is greater than 33.5%, particularly if an Al/Ti is greater than 0.55, the fracture toughness drops at ambient temperature (FIG. 2 of the accompanying drawing). In FIG. 2, X (K1c) represents the fracture toughness and its dimension is $MPa\sqrt{m}$.

Fe plays a very important role in the present invention. Adding Fe lowers the melting point of TiAl by about 30°–40° C. without enlarging a solid-liquid coexisting range of TiAl very much. This insures a desired fluidity during the TiAl casting operation and results in sound or defect-free products. In particular, when a thin casting such as a turbine blade is produced by a precision casting process, the melting point being low means that the good fluidity is maintained in the mold during the casting operation and the generation of coarse lamellar structure is prevented by presence of beta phase, which depends on Fe, even at a relatively high cooling speed, which results in fine cast structure. If Fe is added less than 1.5%, an appropriate fluidity of the melt is not insured, and if Fe is added more than 2.3%, the beta phase precipitation undesirably increases thereby deteriorating cold ductility.

Nb is known as a beta stabilizer (beta former), and helps form more annealing twins and deformation twins which improves cold ductility. Further, I experimented with element(s) that improve the oxidation resistance if added together with Fe and found that Nb is the most preferred element. If Nb is added in less than 1.5% by weight, the cold ductility is not improved, and if Nb is added in more than 4.8%, the combined effect of Nb with Fe produces too much beta phase, which lowers not only the cold ductility but the strength at high temperature. The intermediate range of 2.1–3.7% is excluded since this amount (or percentage) results in 310 Hv (Vickers hardness) or more of castings at as cast state, as shown in FIG. 3 of the accompanying drawings. With this hardness, thin precision cast products such as turbine blades are liable to crack even in the mold and/or the machining (or processing) of castings is difficult.

If B is added 0.18–0.35% (Japanese Patent Application No. 4-88140), the flake-like Ti-B compounds are dispersed and this becomes a cause or starting point of fatigue failure. In this invention, therefore, B is reduced to 0.07–0.12%. This range of B suppresses the precipitation of Ti-B compounds and insures an appropriate fluidity. If B is added in less than 0.07%, a sufficient grain boundary strengthening effect cannot be expected and the microstructure becomes unstable. If B is added in more than 0.12%, the dispersion of Ti-B compounds appears as mentioned above.

It should be noted that if severe oxidation resistance is not necessary, 1.5–2.0% V may be used instead of 1.5–2.0% Nb.

The Al/Ti ratio of TiAl is preferably 0.49–0.55.

DESCRIPTION OF THE PREFERRED EMBODIMENTS

Now, preferred embodiments of the present invention will be described with reference to the accompanying drawings.

TiAl of an embodiment includes by weight percent 31.5–33.5% Al, 1.5–2.0% Fe, 1.5–4.8% (2.1–3.7% exclusive) Nb and 0.07–0.12% B, with the remainder being Ti and inevitable impurities.

TiAl of alternative embodiment includes by weight percent 31.5–33.5% Al, 1.8–2.3% Fe, 1.5–2.0% V and 0.07–0.12% B, with the remainder being Ti and inevitable impurities.

The melting point of the TiAl, which is used as a material for the precision casting, is about 1480° C. This value is lower than that of Ti-34.5 wt % Al (1520° C.) by 30°–40° C. This TiAl is melted at a temperature of 1500° C. or more, for example 1550° C., and poured into a mold to make a shrouded turbine blade by means of a known casting technique. The mold temperature is heated up to about 400°–600° C. The melt is cooled in the mold naturally. The cooling rate is such that the cast TiAl temperature becomes about 800°–1000° C. in about 20 mins. Since the melt is poured into the mold of about 400°–600° C., the melt is not solidified instantly and an appropriate fluidity is maintained prior to the solidification. This makes sound precision casting possible.

Figure 1:
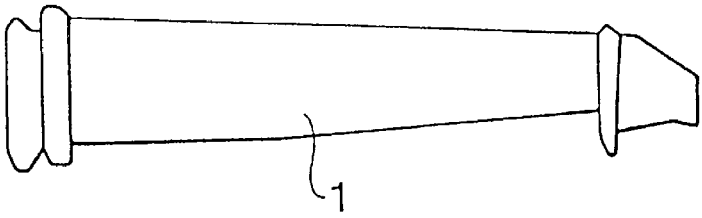
FIG. 1 schematically shows a casting (product) when TiAl of the present invention is used in the precision casting.
Figure 2:
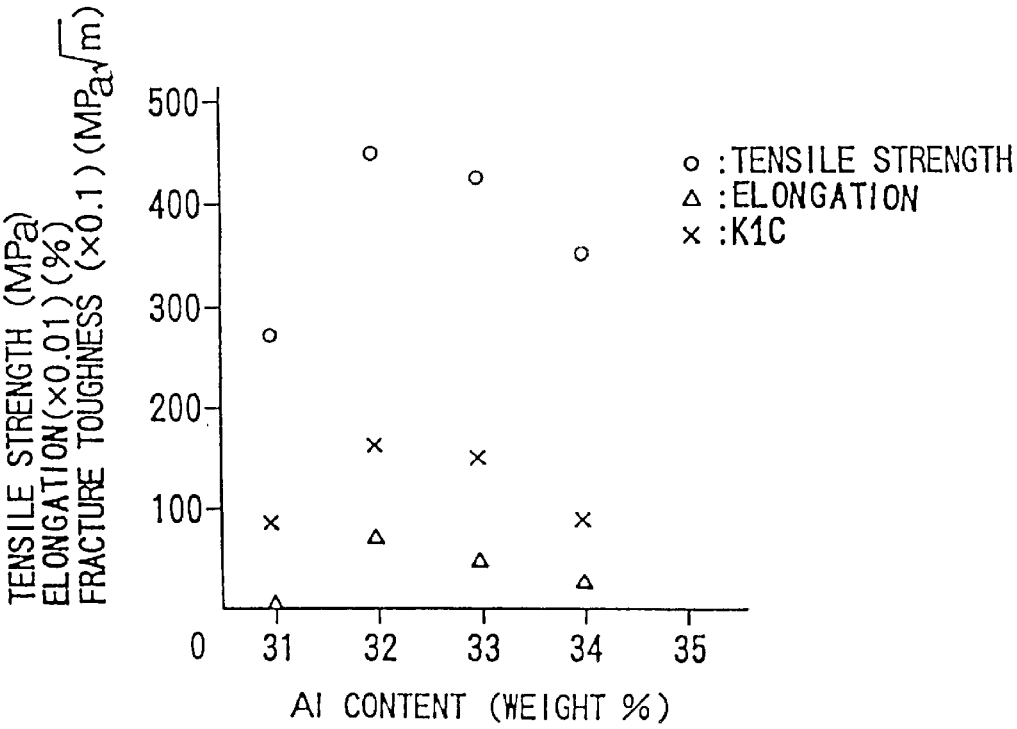
FIG. 2 is a graph showing mechanical properties of TiAl (doped by Fe, Nb, B) in the as-cast state.
Figure 3:
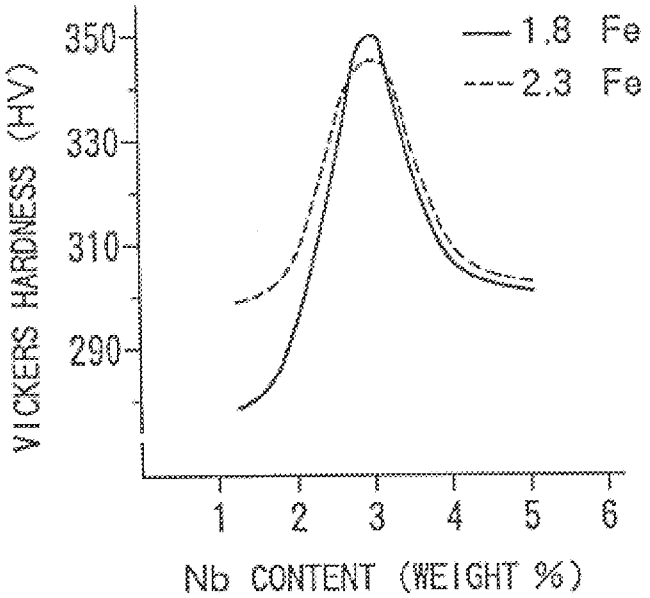
FIG. 3 is a graph showing the hardness of TiAl. (doped by Fe, Nb, B) in the as-cast state.

FIG. 1 shows a shrouded turbine blade 1 made from TiAl of the present invention. This illustration is made from a photograph of the turbine blade actually produced by an experiment.

To compare the turbine blade 1 of the present invention with the turbine blades by other TiAl, prepared are a turbine blade 2 (FIG. 7) using TiAl of Japanese Patent Application No. 4-88140 which is developed by the present inventor and owned by the present assignee and a turbine blade 3 (FIG. 9) using TiAl whose castability is not improved. Like the turbine blade of FIG. 1, the turbine blades of FIGS. 7 and 9 are illustrations made from photographs of actual turbine blades produced by experiments.

Figure 7:
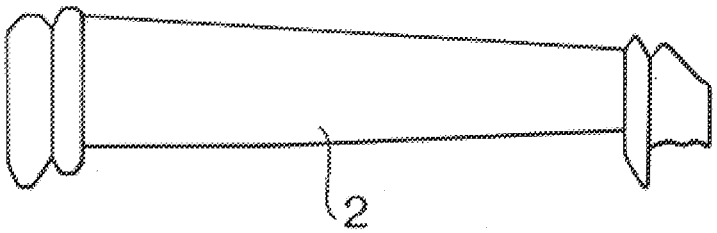
FIG. 7 PRIOR ART
FIG. 7 schematically shows a casting when TiAl of Japanese Patent Application No. 4-88140 is used in the precision casting.
Figure 8:
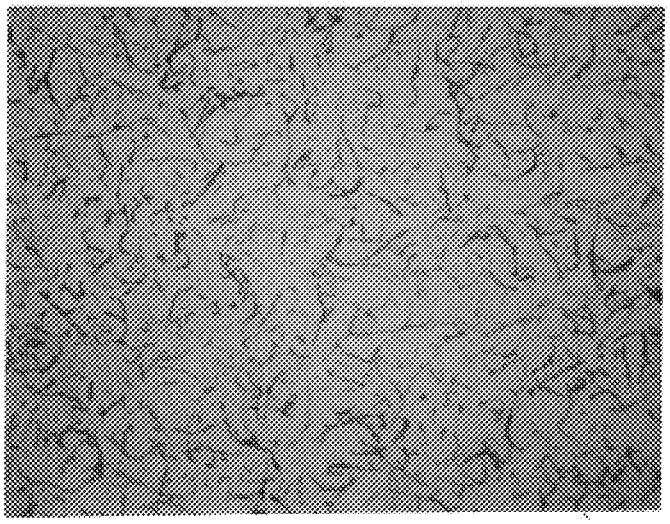
FIG. 8 PRIOR ART
FIG. 8 is a photograph (X400) showing the micro structure of TiAl of FIG. 7.
Figure 9:
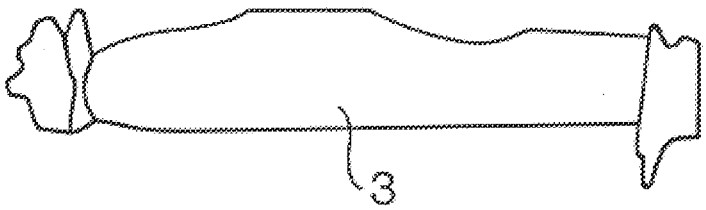
FIG. 9 PRIOR ART
FIG. 9 shows a casting when conventional TiAl whose castability is not improved is used in the precision casting.
Figure 10:
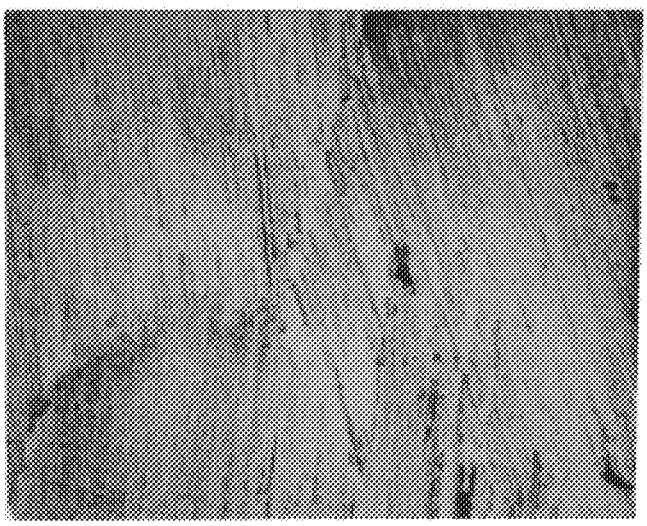
FIG. 10 PRIOR ART
FIG. 10 is a graph (X400) showing coarse lamellar structure of TiAl (Ti-34.5 wt % Al) whose castability is not improved.

Although the same casting technique is employed to produce the turbine blades in FIGS. 1, 7 and 9, the turbine blades 1 and 2 of FIGS. 1 and 7 have completely good shape respectively whereas the fluidity of TiAl of FIG. 9 is not satisfactory and the turbine blade 3 of FIG. 9 does not have an appropriate appearance.

Figure 4:
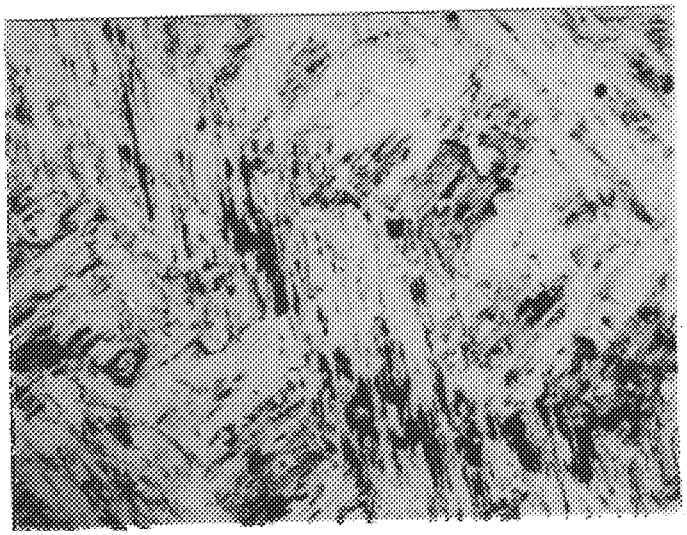
FIG. 4 is a photograph (X200) showing the micro structure of the casting made from TiAl of the present invention.
Figure 5:
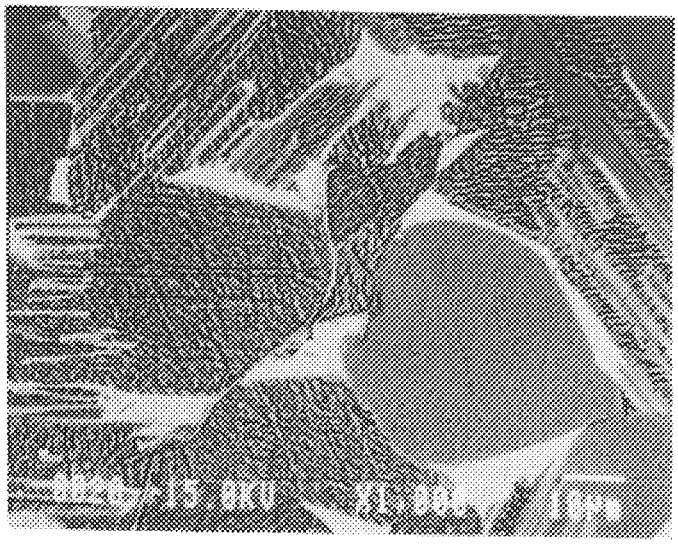
FIG. 5 is a photograph (X1000) showing the micro structure having beta phase (white portions) when Fe is added to TiAl.
Figure 6:
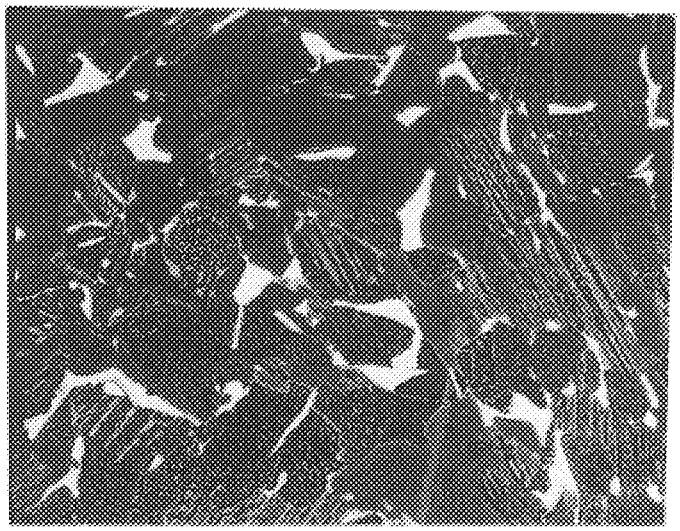
FIG. 6 is a photograph (X10000) showing the micro structure having beta phase (white portions) when Fe is added to TiAl at a higher cooling rate.

TiAl of the present invention is an improvement of TiAl of Japanese Patent Application No. 4-88140. Specifically, TiAl of the present invention was found during the experiments for making TiAl of Japanese Patent Application No. 4-88140 more practical. Al is added 31.5%–33.5% by weight to maintain the ductility at ambient temperature and the fracture toughness at ambient temperature at appropriate levels respectively without deteriorating castability. This primarily owes to the addition of Fe. Specifically, the beta phase (white portions in the photograph) are precipitated around the gamma grains, as seen from the photograph of FIG. 5, and the coarse lamellar structures are not seen. If the cooling rate is relatively high, for example if the melt of about 1550° C. is cooled to about 800°–1000° C. in about 20 minutes, fine and dispersed beta phase are precipitated. As can be understood from FIG. 6, the dispersed beta phase prevents the growth of gamma grains and the growth of coarse lamellar structure caused by the transformation of alpha>gamma+alpha2 ($\alpha \rightarrow \gamma + \alpha_2$). As a result, a fine cast structure is obtained as shown in FIG. 4. Accordingly, the toughness of TiAl in the as-cast state is improved and the crackings are prevented.

B is added 0.07%–0.12% by weight to strengthen the grain boundaries, stabilize the microstructure and prevent the dispersion of flake-like Ti-B compounds which would deteriorate the fatigue properties.

In order to improve the oxidation resistance, the combined effect of several elements and Fe has been experimentally investigated it was found that a certain amount of Nb and Fe improves the oxidation resistance more than the improvement by only Mo or the combination of Nb and Cr. Here, it should be noted that if a great amount of oxidation resistance is not required, V may be used instead of 1.5–2.0% Nb.

As described above, TiAl of the present invention has superior fluidity as well as high strength and relatively high ductility in the as-cast state. Further, the casting made from TiAl of the present invention does not have cracks even if the casting has a thin and complicated configuration. This improves the yield of sound castings. Therefore, the processing of the casting becomes easier and the cost is reduced. The present invention provides TiAl which can be used in actual industry.

According to the present invention, as mentioned earlier, the fluidity of TiAl is improved, the dispersion of flake-like Ti-B compounds which deteriorate the fatigue properties is prevented and the oxidation resistance is improved.

I claim:

1. A method of precision casting an article, comprising the steps of:

(A) preparing a titanium aluminide including by weight 31.5–33.5% of Al, 1.5–2.3% of Fe, one of 1.5–2.1% Nb and 3.7–4.8% Nb and 0.07–0.12% of B with the remainder being Ti and inevitable impurities;

(B) melting the titanium aluminide;

(C) pouring the melt into a mold; and (D) cooling the melt in the mold such that the melt temperature is lowered to about 800°–1,000° C. in about 20 minutes, whereby beta phase is precipitated around gamma particles and coarse lamellar particles are not produced.

2. The method of claim 1, wherein step (B) includes heating the titanium aluminide to 1500° C. or more.

3. The method of claim 2, further including the step of preheating the mold to about 400°–600° C. prior to step (C).

4. The method of claim 3, wherein the mold is a mold for casting a thin and complex shape product.

5. A method of precision casting an article, comprising the steps of:

(A) preparing a titanium aluminide including by weight 31.5–33.5% of Al, 1.5–2.3% of Fe, 1.5–2.0% of V and 0.07–0.12% of B with the remainder being Ti and inevitable impurities, (B) melting the titanium aluminide;

(C) pouring the melt into a mold; and (D) cooling the melt in the mold such that the melt temperature is lowered to about 800°–1,000° C. in about 20 minutes, whereby beta phase is precipitated around gamma particles and coarse lamellar particles are not produced.

6. The method of claim 5, wherein step (B) includes heating the titanium aluminide to 1500° C. or more.

7. The method of claim 6, further including the step of preheating the mold at about 400°–600° C. prior to step (C).

8. The method of claim 7, wherein the mold is a mold for casting a thin and complex shape product.

9. A method of precision casting an article, comprising the steps of:

(A) preparing a titanium aluminide including by weight 31.5–33.5% of Al, 1.5–2.3% of Fe, one of 1.5–2.1% of Nb and 3.7–4.8% Nb, and 0.07–0.12% of B with the remainder being Ti and inevitable impurities;

(B) melting the titanium aluminide;

(C) pouring the melt into a mold; and (D) cooling the melt in the mold at a cooling rate to cause the beta phase to be precipitated around gamma particles in the article and prevent the generation of coarse lamellar particles in the article.

10. The method of claim 9, wherein the step (D) is carried out such that the melt temperature is lowered to 800°–1000° C. in about 20 minutes.

11. The method of claim 9, wherein the step (B) includes heating the titanium aluminide to 1500° C. or more.

12. The method of claim 9, further including the step of preheating the mold to about 400°–600° C. prior to the step (C).

13. A method of precision casting an article, comprising the steps of:

(A) preparing a titanium aluminide including by weight 31.5–33.5% of Al, 1.5–2.3% of Fe, 1.5–2.0% of V and 0.07–0.12% of B with the remainder being Ti and inevitable impurities;

(B) melting the titanium aluminide;

(C) pouring the melt into a mold; and (D) cooling the melt in the mold at a cooling rate to cause the beta phase to be precipitated around gamma particles in the article and prevent the generation of coarse lamellar particles in the article.

14. The method of claim 13, wherein the step (D) is carried out such that the melt temperature is lowered to 800°–1000° C. in about 20 minutes.

15. The method of claim 13, wherein the step (B) includes heating the titanium aluminide to 1500° C. or more.

16. The method of claim 13, further including the step of preheating the mold to about 400°–600° C. prior to the step (C).

* * * * *